US006429130B1

(12) United States Patent
Chuang

(10) Patent No.: US 6,429,130 B1
(45) Date of Patent: Aug. 6, 2002

(54) METHOD AND APPARATUS FOR END POINT DETECTION IN A CHEMICAL MECHANICAL POLISHING PROCESS USING TWO LASER BEAMS

(75) Inventor: Jui-Ping Chuang, Taipei (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 09/451,231

(22) Filed: Nov. 29, 1999

(51) Int. Cl.[7] ..... H01L 21/302

(52) U.S. Cl. ..... 438/690; 438/691; 438/692; 438/693; 438/697

(58) Field of Search ..... 438/690, 691, 438/692, 693, 697

(56) References Cited

U.S. PATENT DOCUMENTS 5,672,095 A * 9/1997 Morimoto et al. ..... 451/41
5,838,448 A * 11/1998 Aiyer et al. ..... 356/652
5,893,796 A * 4/1999 Birang et al. ..... 451/526
6,159,073 A * 12/2000 Wiswesser et al. ..... 451/6
6,190,234 B1 * 2/2001 Swedek et al. ..... 451/6

* cited by examiner

*Primary Examiner*—Benjamin L. Utech
*Assistant Examiner*—Binh X. Tran
(74) *Attorney, Agent, or Firm*—Tung & Associates

(57) ABSTRACT

A method and an apparatus for determining end point in a chemical mechanical polishing process by utilizing two separate laser beams are provided. When two separate laser beams of different wavelengths are utilized, the difference in the wavelengths is at least about 50 nm. For instance, one wavelength may be about 633 nm, while the other wavelength may be about 700~950 nm. When two laser beams of different incident angles are utilized, the difference in the angles may be at least 2°, and preferably at least 5°.

13 Claims, 2 Drawing Sheets

METHOD AND APPARATUS FOR END POINT DETECTION IN A CHEMICAL MECHANICAL POLISHING PROCESS USING TWO LASER BEAMS

FIELD OF THE INVENTION

The present invention generally relates to a method and an apparatus for end point detection in a chemical mechanical polishing process by using two laser beams and more particularly, relates to a method and an apparatus for end point detection in a chemical mechanical polishing process by using two laser beams that have different wavelengths or different incident angles through one or two windows provided in a polishing pad.

BACKGROUND OF THE INVENTION

In the fabrication of semiconductor devices from a silicon wafer, a variety of semiconductor processing equipment and tools are utilized. One of those processing tools is used for polishing thin, flat semiconductor wafers to obtain a planarized surface. A planarized surface is highly desirable on a shadow trench isolation (STI) layer, on an inter-layer dielectric (ILD) or on an inter-metal dielectric (IMD) layer which are frequently used in memory devices. The planarization process is important since it enables the use of a high resolution lithographic process to fabricate the next level circuit. The accuracy of a high resolution lithographic process can be achieved only when the process is carried out on a substantially flat surface. The planarization process is therefore an important processing step in the fabrication of semiconductor devices.

A global planarization process can be carried out by a technique known as chemical mechanical polishing or CMP. The process has been widely used on ILD or IMD layers in fabricating modern semiconductor devices. A CMP process is performed by using a rotating platen in combination with a pneumatically actuated polishing head. The process is used primarily for polishing the front surface or the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face down on a polishing pad covered with a slurry of colloidal silica or aluminum.

A polishing pad used on a rotating platen is typically constructed in two layers overlying a platen with a resilient layer as an outer layer of the pad. The layers are typically made of a polymeric material such as polyurethane and may include a filler for controlling the dimensional stability of the layers. A polishing pad is typically made several times the diameter of a wafer while the wafer is kept off-center on the pad in order to prevent polishing a non-planar surface onto the wafer. The wafer itself is also rotated during the polishing process to prevent polishing a tapered profile onto the wafer surface. The axis or rotation of the wafer and the axis of rotation of the pad are deliberately not collinear, however, the two axes must be parallel. It is known that uniformity in wafer polishing by a CMP process is a function of pressure, velocity and concentration of the slurry used.

A CMP process is frequently used in the planarization of an ILD or IMD layer on a semiconductor device. Such layers are typically formed of a dielectric material. A most popular dielectric material for such usage is silicon oxide. In a process for polishing a dielectric layer, the goal is to remove typography and yet maintain good uniformity across the entire wafer. The amount of the dielectric material removed is normally between about 5000 Å and about 10,000 Å. The uniformity requirement for ILD or IMD polishing is very stringent since non-uniform dielectric films lead to poor lithography and resulting window etching or plug formation difficulties. The CMP process has also been applied to polishing metals, for instance, in tungsten plug formation and in embedded structures. A metal polishing process involves a polishing chemistry that is significantly different than that required for oxide polishing.

The important component needed in a CMP process is an automated rotating polishing platen and a wafer holder, which both exert a pressure on the wafer and rotate the wafer independently of the rotation of the platen. The polishing or the removal of surface layers is accomplished by a polishing slurry consisting mainly of colloidal silica suspended in deionized water or KOH solution. The slurry is frequently fed by an automatic slurry feeding system in order to ensure the uniform wetting of the polishing pad and the proper delivery and recovery of the slurry. For a high volume wafer fabrication process, automated wafer loading/unloading and a cassette handler are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydrogenation reaction; the formation of hydrogen bonds between the wafer and the slurry; the formation of molecular bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against a wafer surface.

While the CMP process provides a number of advantages over the traditional mechanical abrasion type polishing process, a serious drawback for the CMP process is the difficulty in end point detection. The CMP process is frequently carried out without a clear signal about when the process is completed by using only empirical polishing rates and time polish. Since the calculation of polish time required based on empirical polishing rates is frequently inaccurate, the empirical method fails frequently resulting in serious yield drops. Attempts have been made to utilize an end point mechanism including those of capacitance measurements and optical measurements. However, none of these techniques have been proven to be satisfactory in achieving accurate control of the dielectric layer removed.

Another method for achieving end point detection is marketed by the Applied Material Corporation of Santa Clara, Calif. in a Mirra® CMP device. In the Mirra® device, a system of in-situ rate monitor (ISRM) is provided to determine end point by the concept of a periodic change of optical interference. In the Mirra® device, signals received from a patterned wafer surface are processed by digital filtering algorithms by a PC programmable filter such that an optical interference intensity changes periodically with the thicknesses of removed surface material. For instance, a built-in laser source which is fixed at 6,700 Å wavelength is utilized to cause interference at a wafer surface and thus producing a waveform received by a laser detector. The waveform generated by such a technique is shown in FIG. 1.

FIG. 1 illustrates four cycles of a waveform with each cycle corresponds to a removed material layer thickness of approximately 2437 Å. The technique is adequate to detect an end point in a polishing process wherein only a relatively thin layer, for instance, of only 2000 Å is removed. When a large thickness of material such as an IMD oxide layer having a thickness of at least 4000 Å is to be removed, the method frequently produces faulty results since the laser detector cannot distinguish which one of the waveform cycles the end point falls on. The wafer surface can therefore be either overpolished or under-polished by 2400 Å thickness. In other words, it is difficult for an operator to properly set a "window" of the polishing process to accurately control the thickness of the layer to be removed.

FIG. 2 illustrates a cross-sectional view of a conventional CMP apparatus such as supplied by the Applied Materials Corporation of an in-situ rate monitor system 10. In the ISRM system, a platen is equipped with a laser source capable of generating laser emissions and receiving signals from a patterned wafer surface such that the signals are processed by digital filtering algorithms by a PC programmable filter and that an optical interference intensity changes periodically with the thicknesses of removed surface material. A plane view of the conventional CMP apparatus 10 that has a wafer sample 16 positioned on a rotating platen 12 and window 40 in the platen is shown in FIG. 3.

In the apparatus 10 shown in FIG. 2, a polishing platen 12 which is intimately joined to a polishing pad 14 is used as the rotating platen in the CMP apparatus 10. The rotating platen 12 is equipped with a laser emitter, or a laser generating device 20 which includes a semiconductor diode (not shown) capable of generating laser emissions at a predetermined wavelength. As shown in FIG. 2, laser emission 22 is generated by the semiconductor diode at a desirable frequency. A semiconductor wafer 16 which consists of an oxide coating layer 18 overlying a base material layer 28 is shown. The base material layer be formed of any suitable materials such as silicon, polysilicon or metal. The semiconductor wafer 16 is pressed onto a rotating platen 12 such that a top surface 32 of the oxide layer 18 intimately contacts and frictionally engages a top surface 34 of the polishing pad 14. Laser emission 22 from the laser emitter 20 irradiates onto surface 32 of the oxide layer 18 through a window 40 that is provided in the polishing pad 14. A plane view of the window 40 is shown in FIG. 3. The laser emission 22 from the laser emitter 20 are partially reflected by the oxide surface 32 into reflected beam 36. Part of the laser beam 22 penetrates into the oxide layer 18 and are then reflected by the interface 50 formed between the oxide layer 18 and the base layer 28. The reflected beams are then deflected at the oxide surface 32 into laser beam 56 to be received by the laser detector 30.

The traditional technique of ISRM is only adequate for the detection of end point in a polishing process wherein only a relatively thin layer of material is removed. When a larger thickness of material on a semiconductor structure, such as an IMD oxide layer that has a thickness of 4000 Å or larger is to be removed, the conventional ISRM technique frequently produces faulty results since the laser detection device cannot distinguish which one of the wave form cycles that the end point falls on. As a result, it is quite possible that the wafer surface can be either over-polished or under-polished by a thickness as large as 2400 Å. As a result, it is difficult for an operator to properly set a "window" for the polishing process in order to accurately control the thickness of the layer to be removed.

It is therefore an object of the present invention to provide a method for determining end point in a CMP process utilizing an optical interference technique that does not have the drawbacks or the shortcomings of the conventional methods.

It is another object of the present invention to provide a method for determining an end point in a CMP process by utilizing two laser emitters each having a different wavelength for reflecting off the surface of a wafer.

It is a further object of the present invention to provide a method for determining an end point in a CMP process by utilizing two laser emitters each having a different incident angle for reflecting off the surface of a polished wafer.

It is another further object of the present invention to provide a method for determining an end point in a CMP process wherein laser emissions having different wavelengths are utilized to produce a constructive wavelength interference pattern.

It is still another object of the present invention to provide a method for determining an end point in a CMP process by utilizing two laser emitters each emitting a laser emission having a different wavelength than the other wherein the difference between the two wavelengths is at least 50 nm.

It is yet another object of the present invention to provide a method for determining an end point in a CMP process by utilizing two laser emitters each having different incident angles for reflecting off a wafer surface wherein the difference in the incident angle is at least 2°.

It is still another further object of the present invention to provide an apparatus for determining an end point in a CMP process that is equipped with two laser beams wherein each of the beams emits a laser emission at a different wavelength.

It is yet another further object of the present invention to provide an apparatus for determining an end point in a CMP process that is equipped with two laser beams each emitting a laser emission at a different incident angle to a wafer surface.

SUMMARY OF THE INVENTION

In accordance with the present invention, a method and an apparatus for conducting an end point detection in a chemical mechanical polishing process by utilizing two laser beams are disclosed.

In a preferred embodiment, a method for determining an end point in a CMP process by using two laser beams can be carried out by the operating steps of providing a wafer surface, polishing the wafer surface by a polishing pad, directing a first laser beam at the wafer surface producing a first reflected beam, directing a second laser beam at the wafer surface producing a second reflective beam, collecting and analyzing the first and second reflective beams by a detector for determining an end point of the CMP process.

In the method for determining an end point in a CMP process by using two laser beams, the first and second laser beams may have different incident angles. The first and second laser beams may have different wavelengths. The method may further include the step of forming a constructive interference when the first reflective beam and the second reflective beam are collected and analyzed by the detector. The first laser beam and the second laser beam are directed at the wafer surface through a single window formed in the polishing pad. The first laser beam and the second laser beam may be directed at the wafer surface through two separate windows formed in the polishing pad. The first laser beam may have a wavelength smaller than 650 nm and the second laser beam may have a wavelength larger than 700 nm. The first laser beam may have a wavelength that is different than a wavelength of the second laser beam by at least 50 nm.

In another preferred embodiment, a method for determining an end point in a chemical mechanical polishing process by using two laser beams that have different incident angles can be carried out by the steps of providing a wafer surface to be polished, providing a polishing platen that has a polishing pad installed thereon, installing at least two laser emitters and a laser detector in the polishing platen, engaging the wafer surface and a top surface of the polishing pad intimately together while the wafer and the polishing pad are rotated in opposite directions, detecting a first laser beam from one of the at least two laser emitters at the wafer surface at a first incident angle producing a first reflective beam, directing a second laser beam from the other one of the at least two laser emitters at the wafer surface at a second incident angle different than the first incident angle producing a second reflective beam, and receiving the first reflective beam and the second reflective beam into a laser detector and forming a constructive interference for predicting an end point of the CMP process.

The method for determining an end point in a CMP process by using two laser beams that have different incident angles may further include the step of directing a second laser beam at the wafer surface at a second incident angle that is different by at least 2° from the first incident angle producing a second reflective beam. The method may further include the step of directing the first laser beam and the second laser beam from the at least two laser emitters through a single window provided in the polishing pad. The method may further include the step of providing the first and second laser beams with substantially the same wavelength. The method may further include the step of providing the first and the second laser beams with a wavelength in the range between about 100 nm and about 10,000 nm.

The present invention is further directed to an apparatus for determining an end point in a chemical mechanical polishing process that is equipped with two laser beams including a wafer that has a top surface to be polished, a polishing platen that has a polishing pad installed thereon, at least two laser emitters and a laser detector installed therein, means for intimately engaging the top surface of the wafer to a polishing surface of the polishing pad, means for rotating the wafer and the polishing platen in opposite directions, at least one window in the polishing pad for laser beam emitted by the at least two laser emitters to go therethrough, a first laser beam from one of the at least two laser emitters projected at the top surface of the wafer producing a first reflective beam, and a second laser beam from the other one of the at least two laser emitters projected at the top surface of the wafer producing a second reflected beam, the first reflective beam and the second reflective beam are received by the laser detector to produce a constructive interference spectrum indicative of an end point of the CMP process.

In the apparatus for determining an end point in a CMP process equipped with two laser beams, the first laser beam has a different wavelength than the second laser beam. The first laser beam may have a wavelength smaller than 650 nm and the second laser beam may have a wavelength larger than 700 nm. The first laser beam may have a different incident angle on the top surface of the wafer than the second laser beam. The first laser beam may have an incident angle that is at least 2° different than an incident angle of the second laser beam. The at least one window may include two windows in the polishing pad for the at least two laser beams to penetrate therethrough.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a method and an apparatus for the end point detection in a chemical mechanical polishing process by utilizing two separate laser beams projected through a single window or two separate windows in a polishing pad onto the surface of a polished wafer.

The method for end point detection in a CMP process can be carried out by using two separate laser beams emitted from two laser emitters which have either different wavelengths or different incident angles onto a wafer surface. The laser emissions can be projected through a single window or two separate windows provided in a polishing pad onto the polished wafer surface. The reflected laser beams from the polished wafer surface are then collected by a laser detector mounted in the polishing platen for analysis and for determining an end point of the CMP process. The reflected laser beams from the polished wafer surface normally forms a constructive interference curve that can be utilized advantageously for the prediction of the end point.

When two laser beams of different wavelengths are utilized, the first laser beam may have a wavelength smaller than 650 nm, while the second laser beam may have a wavelength larger than 700 nm. The difference between the wavelengths of the two laser beams is preferably at least about 50 nm. The word "about" in the context of this write up is used to indicate a range of value that is ±10% from that given as the average value. For instance, about 50 nm means a range between 45 nm and 55 nm.

The present invention novel apparatus further utilizes two separate laser emitters for emitting two separate laser beams that are projected at a wafer surface at different incident angles. The difference between the two incident angles is at least about 2°, while a difference of about 5° or more is preferred. When the two laser beams having different incident angles are utilized, the laser beams may have a wavelength in the range between about 100 nm and about 10,000 nm.

The present invention still further provides an apparatus for determining an end point in a CMP process that is equipped with two laser beams which includes a wafer holder for holding a wafer thereon, a polishing platen that has a polishing pad installed thereon and at least two laser emitters and a laser detector installed inside the platen, means for intimately engaging a top surface of the wafer to a polishing surface of the polishing pad and means for rotating the wafer and the polishing pad in opposite directions. At least one window in the polishing pad for passing through the laser beams is provided, while two separate windows in the polishing pad may be more preferred.

Figure 1:
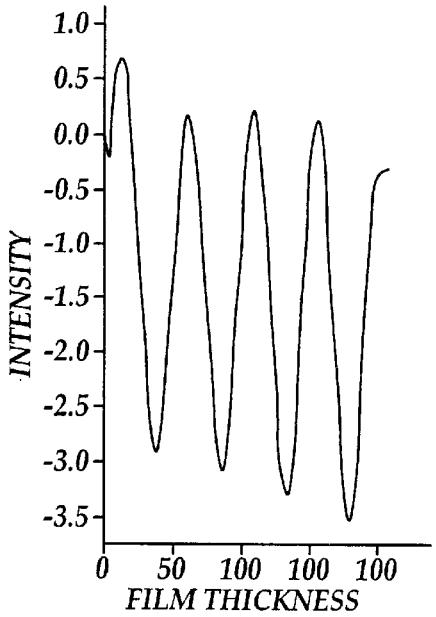
Figure 1 Prior Art
FIG. 1 is a graph illustrating an optical interference curve generated by a laser of 670 nm wavelength and reflected from the surface of an oxide layer indicating a period between cycles of about 243 nm.
Figure 2:
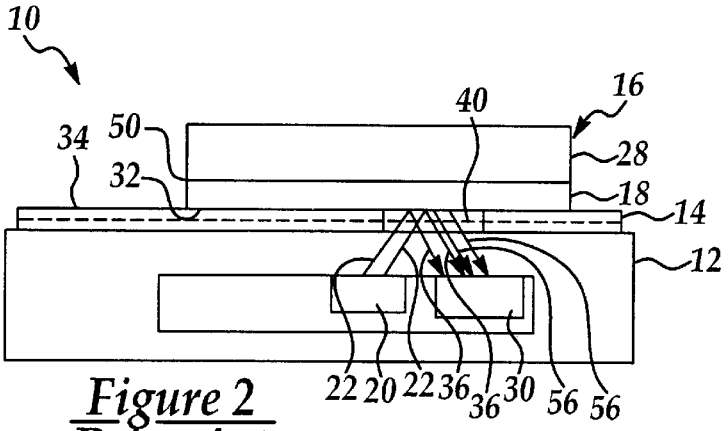
Figure 2 Prior Art
FIG. 2 is a cross-sectional view of a conventional CMP apparatus wherein a platen is equipped with a laser source capable of generating laser emissions for projecting on a wafer surface.
Figure 3:
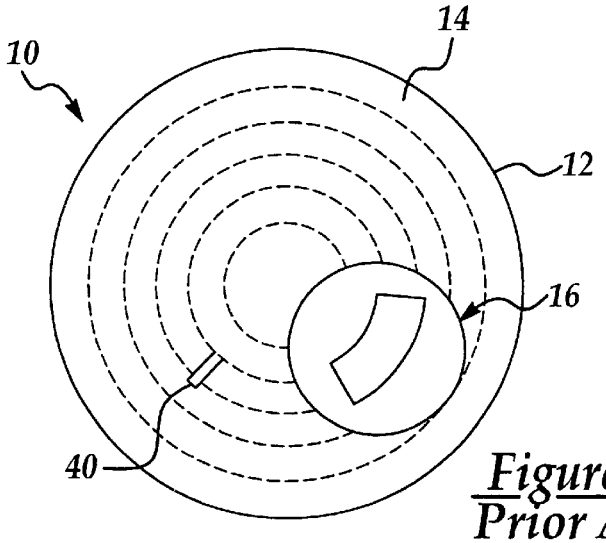
Figure 3 Prior Art
FIG. 3 is a plane view of the conventional CMP apparatus shown in FIG. 2 with a wafer sample positioned on a polishing platen and a window in the polishing pad for laser emission.
Figure 4:
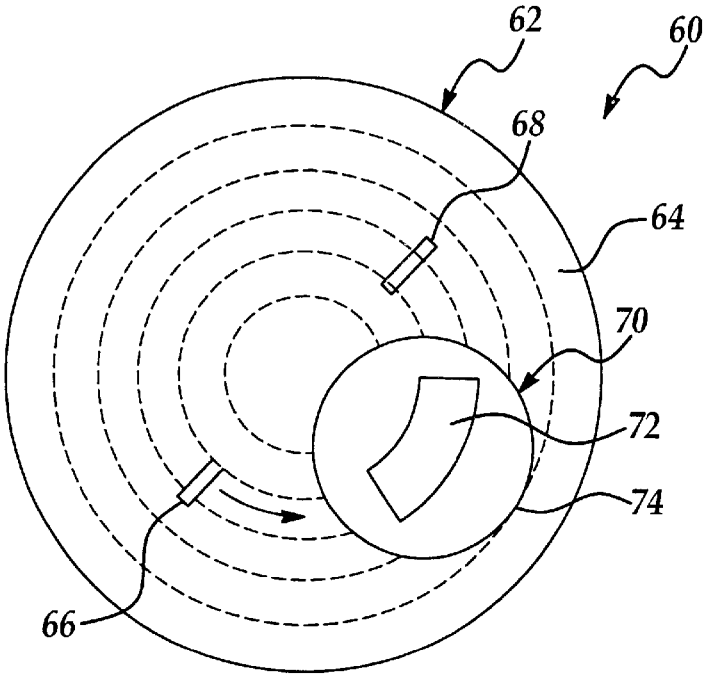
FIG. 4 is a plane view of the present invention apparatus with a wafer sample positioned on a polishing pad equipped with two windows for passing therethrough two separate laser beams.

Referring now to FIG. 4, wherein a present invention apparatus 60 having a polishing platen 62 and a polishing pad 64 installed thereon is shown. The polishing pad 64 is equipped with windows 66 and 68 for two laser beams (not shown) to penetrate therethrough and project on the surface of a rotating wafer 70. The fan-shaped shaded section 72 on the wafer 70 indicates an area that is exposed to the windows 66, 68 when the wafer 70 is rotated on the polishing pad 64. In this embodiment, two separate laser emitters may be mounted in a polishing platen that are directed at different angles upwardly toward the windows such that two laser beams are projected onto the wafer surface 74 that faces the polishing pad 64.

In the embodiment shown in FIG. 4, two separate ruby laser sources are utilized to generate laser emissions at different incident angles projected on the wafer surface. Two separate end point windows 66, 68 are therefore preferred and can be more advantageously utilized. By utilizing the two separate end point trace signals generated by the two laser beams, the frequently seen mis-calculation due to repeating order of a single wavelength can be eliminated. The accuracy for the thickness control of the CMP process can thus be greatly improved.

Figure 5A:
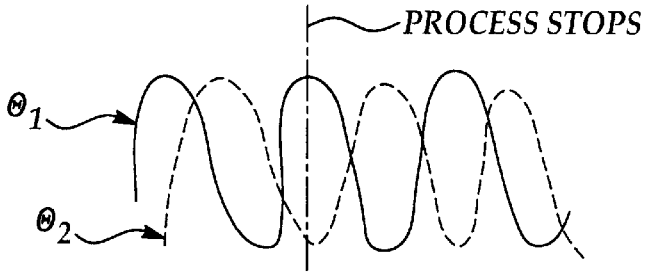
FIG. 5A is a graph illustrating a composite wavelength interference curve generated by the present invention novel apparatus wherein two laser beams of different incident angles are projected on a polished wafer surface.

In the arrangement shown in FIG. 4, the following equation can be used for the simple calculation:

$$2d \sin \theta = N_x \lambda$$

Where d is the film thickness, $\lambda$ is about 633 nm for the system utilizing a ruby laser source. When two pad windows 66, 68 are utilized, one laser emitter is provided for each pad window for emitting a laser beam therethrough. The two laser beams have different incident angle when projected onto a polished surface of the wafer. This is shown in FIG. 5A. Since the incident angles are different for the two laser beams, there is a time delay between the two wave spectra. The CMP process can be stopped at the end point when detected by the constructive interference curve formed by the two individual curves of FIG. 5A. The process of utilizing two laser beams having different incident angles projected toward a polished wafer surface may also be performed through a single pad window that is provided in a polishing pad. Two separate laser beams having the same wavelength can be used as long as the incident angle of the laser beam is different by at least 2°, and preferably different by at least 5° or more.

Figure 5B:
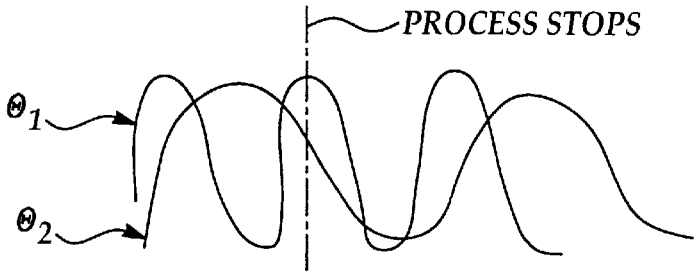
FIG. 5B is a graph illustrating a composite wavelength interference curve generated by the present invention apparatus which is equipped with two laser beams each having a different wavelength.

The present invention novel method can further be carried out by using the same incident angle for two laser beams, but at different wavelengths. This is shown in FIG. 5B. When two different wavelengths $\lambda_1$ and $\lambda_2$ are used, the light deflection theory can be expressed by the equations of:

$$2d \sin \theta = N_x \lambda_1$$

$$2d \sin \theta = N_y \lambda_2$$

wherein $\lambda_1$ is about 633 nm and $\lambda_2$ is between about 700 and about 950 nm.

In this method of utilizing two laser beams having different wavelengths, two separate windows in the polishing pad is normally provided. The laser beam having the wavelength of 633 nm is projected through one window, while the laser beam having a wavelength between about 700 and about 950 nm is projected through another window. By combining the end point signal traces, as shown in FIG. 5B, the desired polish thickness can be obtained which is independent of pre-CMP thickness variations. The CMP process can be advantageously stopped when the end point is detected in the wave spectra shown in FIG. 5B. In the application wherein two separate laser beams having two different wavelengths are utilized, a constructive interference pattern of the wave spectra is normally obtained for the determination of end point.

The present invention novel method and apparatus for end point detection in a CMP process by utilizing two separate laser beams have therefore been amply described in the above description and in the appended drawings of FIGS. 4, 5A and 5B.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

1. A method for determining an end point of a chemical mechanical polishing (CMP) process by using two laser beams comprising the steps of:

providing a wafer surface, polishing said wafer surface by a polishing pad, directing a first laser beam at said wafer surface producing a first reflected beam, directing a second laser beam at said wafer surface producing a second reflected beam, and collecting and analyzing said first and second reflected beams by a detector forming a constructive interference for determining an end point of said CMP process.

2. A method for determining an end point in a CMP process by using two laser beams according to claim 1, wherein said first and second laser beams have different incident angles.

3. A method for determining an end point in a CMP process by using two laser beams according to claim 1, wherein said first and second laser beams have different wavelengths.

4. A method for determining an end point in a CMP process by using two laser beams according to claim 1, wherein said first laser beam and said second laser beam are directed at said wafer surface through a single window formed in said polishing pad.

5. A method for determining an end point in a CMP process by using two laser beams according to claim 1, wherein said first laser beam and said second laser beam are directed at said wafer surface through two separate windows formed in said polishing pad.

6. A method for determining an end point in a CMP process by using two laser beams according to claim 5, wherein said first laser beam having a wavelength smaller than 650 nm and said second laser beam having a wavelength larger than 700 nm.

7. A method for determining an end point in a CMP process by using two laser beams according to claim 5, wherein said first laser beam having a wavelength that is different than a wavelength of said second laser beam by at least 50 nm.

8. A method for determining an end point in a chemical mechanical polishing (CMP) process by using two laser beams having different incident angles comprising the steps of providing a wafer surface to be polished, providing a polishing platen having a polishing pad installed thereon, installing at least two laser emitters and a laser detector in said polishing platen, engaging said wafer surface and a top surface of said polishing pad intimately together while said wafer and said polishing pad are rotated in opposite directions, directing a first laser beam from one of said at least two laser emitters at said wafer surface at a first incident angle producing a first reflected beam, directing a second laser beam from the other one of said at least two laser emitters at said wafer surface at a second incident angle different than said first incident angle producing a second reflected beam, and receiving said first reflected beam and said second reflected beam into a laser detector and forming a constructive interference for predicting an end point of said CMP process.

9. A method for determining an end point in a CMP process by using two laser beams having different incident angles according to claim 8 further comprising the step of directing a second laser beam at said wafer surface at a second incident angle that is different by at least 2° from said first incident angle producing a second reflected beam.

10. A method for determining an end point in a CMP process by using two laser beams having different incident angles according to claim 8 further comprising the step of directing said first laser beam and said second laser beam from said at least two laser emitters through a single window provided in said polishing pad.

11. A method for determining an end point in a CMP process by using two laser beams having different incident angles according to claim 8 further comprising the step of directing said first laser beam and said second laser beam from said at least two laser emitters through two separate windows provided in said polishing pad.

12. A method for determining an end point in a CMP process by using two laser beams having different incident angles according to claim 8 further comprising the step of providing said first and second laser beams with substantially the same wavelength.

13. A method for determining an end point in a CMP process by using two laser beams having different incident angles according to claim 8 further comprising the step of providing said first and second laser beams with a wavelength in the range between about 100 nm and about 10,000 nm.

* * * * *